United States Patent [19]

Rieth et al.

[11] 4,332,061

[45] Jun. 1, 1982

[54] ADJUSTABLE BRACELET CLASP

[75] Inventors: Kurt A. Rieth, Warwick; Stephen F. Bert, W. Warwick, both of R.I.

[73] Assignee: Textron, Inc., Providence, R.I.

[21] Appl. No.: 148,988

[22] Filed: May 12, 1980

[51] Int. Cl.[3] ..... A44B 11/25

[52] U.S. Cl. ..... 24/343; 24/265 WS; 24/191

[58] Field of Search ..... 24/265 WS, 265 CC, 241 P, 24/68 J, 69 J, 191, 311, 78

[56] References Cited

U.S. PATENT DOCUMENTS

| | | | |
|---|---|---|---|
| 3,425,104 | 2/1969 | Mochizuki | 24/265 WS |
| 3,711,906 | 1/1973 | Leon | 24/265 WS |
| 3,795,028 | 3/1974 | Weiss | 24/311 |
| 4,158,904 | 6/1979 | Learn | 24/265 WS |
| 4,198,732 | 4/1980 | Rieth et al. | 24/191 |

*Primary Examiner*—James A. Leppink

*Attorney, Agent, or Firm*—Thompson, Birch, Gauthier & Samuels

[57] ABSTRACT

An adjustable clasp for interconnecting two sections of a bracelet, including in combination a coupling assembly secured to the end of one bracelet section, and a clamp assembly detachably fixable at selected locations along the length of the other bracelet section. The clamp assembly has a bottom wall with opposed side walls extending substantially normal thereto. A resilient pressure plate is supported by the side walls at a location cooperating with the bottom wall to define a space therebetween for receiving the said other bracelet section. A rigid clamping member also is supported by the side walls. The clamping member is adjustable between an open position allowing limited movement of the pressure plate relative to the bottom wall in order to accommodate slidable movement of the said other bracelet section through said space, and a closed position resiliently deflecting the pressure plate to positively grip the said other bracelet section between the pressure plate and the bottom wall.

7 Claims, 8 Drawing Figures

ADJUSTABLE BRACELET CLASP

BACKGROUND OF THE INVENTION

This invention relates to an improved adjustable clasp of the type employed to interconnect two sections of a bracelet, for example a watch bracelet, on the wrist of a wearer.

As shown in U.S. Pat. No. 4,198,732, the known adjustable clasp consists of a coupling assembly which is secured to the end of one bracelet section, and which is adapted for detachable engagement with a clamp assembly on the other bracelet section. The clamp assembly has a rigid bottom wall with upstanding side walls carrying both a rigid movable pressure plate and a pivotal resilient clamping member. Adjustability is achieved by slidably inserting the other bracelet section between the bottom wall and the pressure plate. Then, the clamping member is pivoted to a closed position at which it resiliently acts against the pressure plate to clamp the bracelet section between the pressure plate and the bottom wall. The side walls also support a cross pin to which the coupling assembly is detachably engaged.

Although experience has indicated that the above-described clasp works quite satisfactorily, it has been found that the resilient clamping member is difficult to manufacture, particularly for the narrower clasp widths required for ladies' bracelets. Because of its relatively complex design, the resilient clamping member is also an expensive component. The use of a cross pin in addition to the pressure plate and resilient clamping member further contributes to the overall cost of the clasp. The appearance of the clasp is also compromised somewhat by the additional holes needed in the side walls to accommodate the ends of the cross pin.

SUMMARY OF THE INVENTION

As opposed to the rigid pressure plate of the conventional clasp, the pressure plate of the present invention is resilient, preferably consisting of a slightly arcuate spring-like metal stamping with an upturned lip at one end. The clamping member of the present invention is rigid, with a simple uncomplicated design which in comparison to the conventional design is much easier and less expensive to manufacture. The clamping member is positioned to resiliently deflect the pressure plate into its clamped position.

The coupling assembly is detachably engageable with the upturned lip on the resilient pressure plate, thus making it possible to eliminate the cross pin of the previous clasp. This further reduces the cost of the clasp, while also eliminating one set of holes in the side walls.

The clamping member of the present invention is provided with lateral ears received in circular holes in the side walls. The ears are externally rounded to cooperate with the circular holes in providing a smooth rotating motion as the clamping member is pivoted into and out of engagement with the resilient pressure plate.

DETAILED DESCRIPTION OF INVENTION

Figure 1:
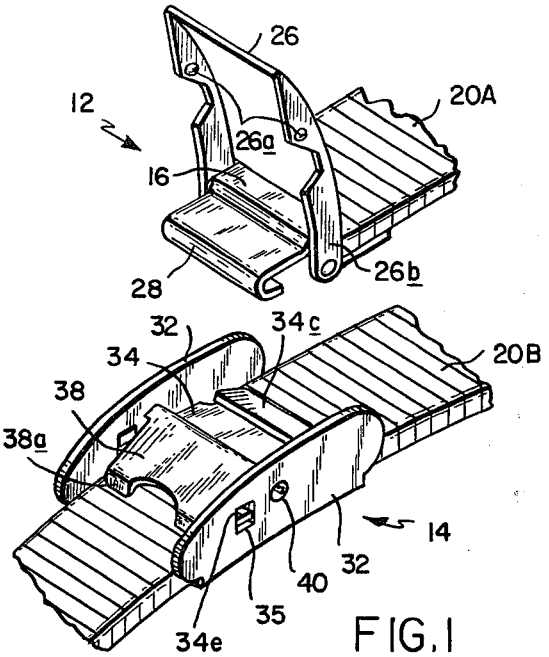
FIG. 1 is a perspective view of the clasp of the present invention, showing the coupling assembly detached from the clamp assembly.

Referring to the drawings, an adjustable clasp 10 in accordance with the present invention is shown comprising the combination of a coupling assembly 12 and a clamp assembly 14.

Figure 2:
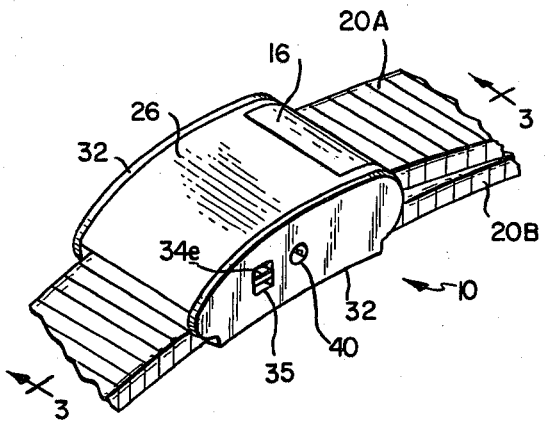
FIG. 2 is a perspective view of the clasp with the coupling assembly connected to the clamp assembly.
Figure 3:
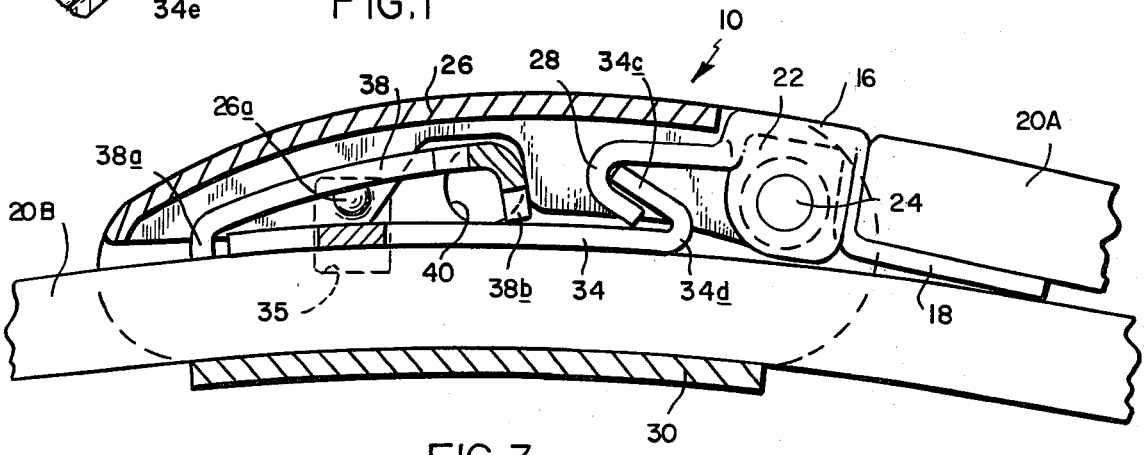
FIG. 3 is a sectional view on an enlarged scale taken along line 3—3 of FIG. 2.
Figure 4:
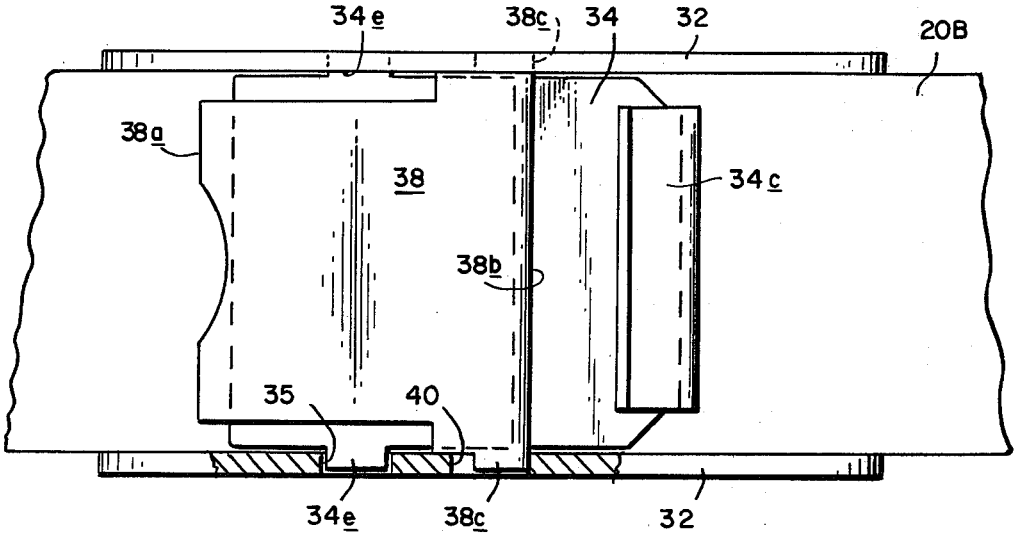
FIG. 4 is a top plan view of the clamp assembly at a fixed position along the length of the other bracelet section.

The coupling assembly is of generally conventional design, having a base frame 16 with a rearward extension 18 secured by any known means to the end of one bracelet section 20A. For example, where the bracelet section 20A is fabricated from metal, it can be connected to the extension 18 by spot welding. The base frame 16 has depending sides 22 with aligned holes receiving the ends of a cross pin 24. The pin 24 provides the means for pivotally connecting a cover 26 to the base frame 16. The base frame also has a forwardly extending hook 28 arranged to underlie the cover 26 when the latter is in the closed position as shown in FIGS. 2 and 3.

The clamp assembly 14 has a bottom wall 30 with opposed side walls 32 extending substantially normal thereto. A resilient pressure plate 34 overlies the bottom wall 30 and cooperates therewith to define a space 36 for slidably receiving the other bracelet section 20B.

Figure 5:
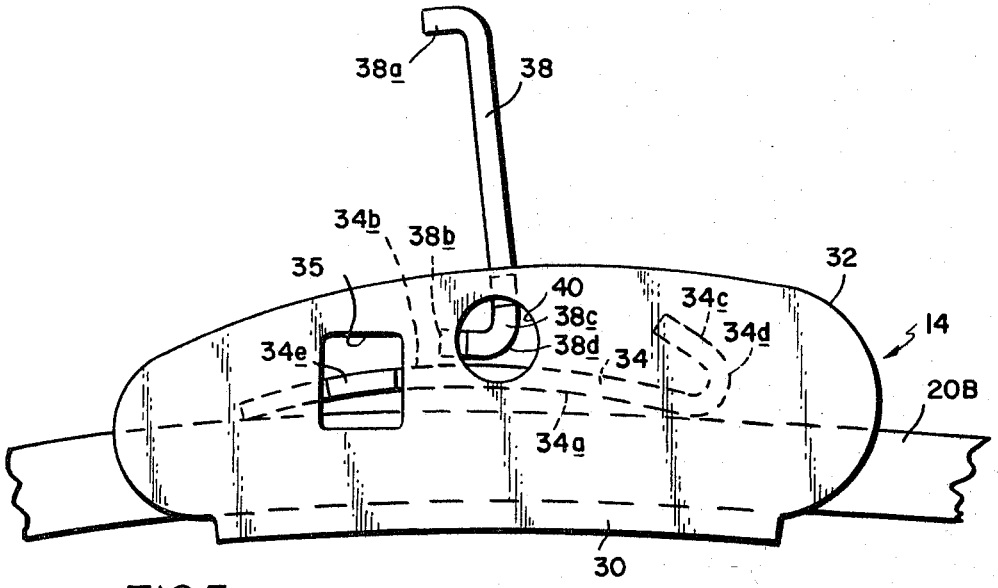
FIGS. 5–7 are side elevational views of the clamp assembly at various stages of adjustment.

When the pressure plate 34 is in its relaxed or unstressed condition as shown in FIG. 5, it is arcuately shaped in side elevation, with a concave side **34*a* facing downwardly towards the bottom wall 30, and with a convex side 34*b* facing upwardly. The radius of curvature of the pressure plate extends from an axis (not shown) which is transverse to the direction of slidable movement of bracelet section 20B through space 36**.

Pressure plate 34 further includes an integrally formed upturned lip **34*c* joined to one end of the pressure plate. The juncture between the lip 34*c* and the arcuate portion of the pressure plate is curved to provide a rounded nose 34*d***.

Ears **34*e* protrude laterally from the pressure plate into rectangular holes 35 in the side walls 32. The holes 35 are somewhat enlarged relative to the size of the ears 34*e* to thereby accommodate limited movement of the pressure plate 34 relative to the bottom wall 30. This feature enables the clamp assembly to accommodate bracelet sections of different thicknesses in the space 36**.

A clamping member 38 is located on the convex side **34*b* of the pressure plate 34. The clamping member is a rigid stamped element having a relatively simple shape with a flat planar section terminating at downturned noses 38*a*, 38*b* at its opposite ends. Laterally extending ears 38*c* are provided at the end adjacent to the nose 38*b*. The ears 38*c*, which have rounded external segments 38*d*, are received in aligned round holes 40 in the side walls 32. The radius of curvature of the rounded external segments 38*d* on the ears 38*c* is approximately equal to the radius of the round holes 40. The holes 40 cooperate with the ears 38*d* to define an axis which extends in a direction transverse to the direction of movement of the bracelet section through the space 36**, and about which the clamping member is rotatable.

Figure 6:
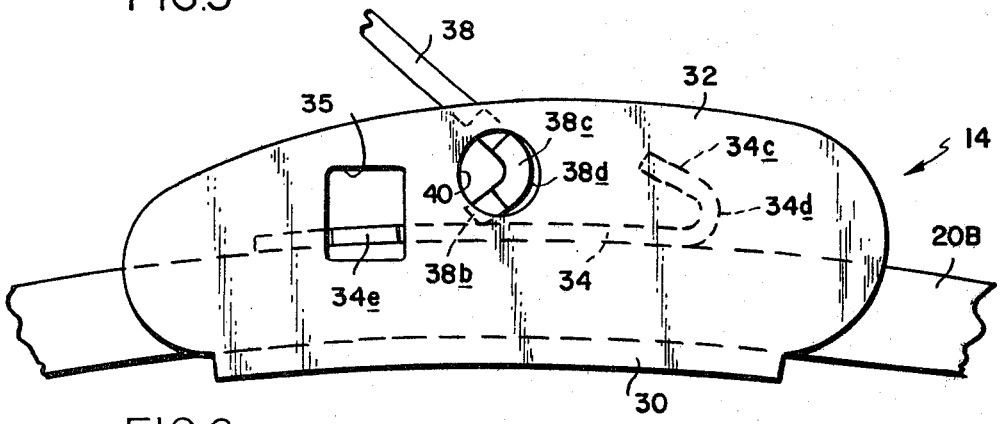
Figure 7:
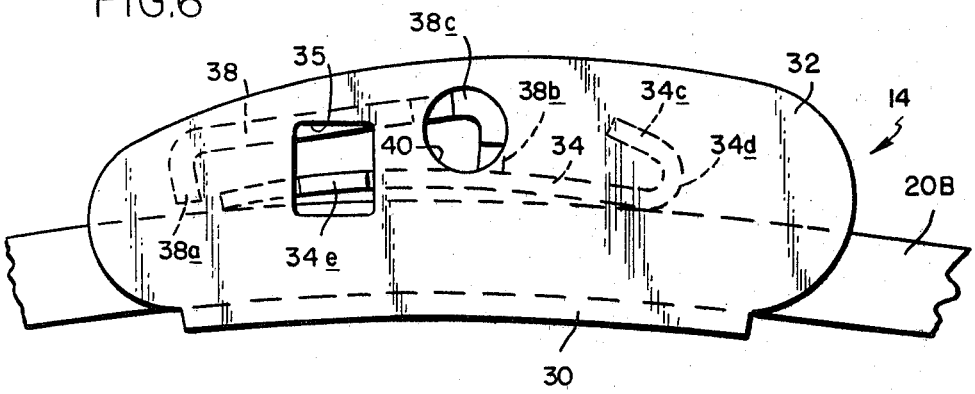
Figure 8:
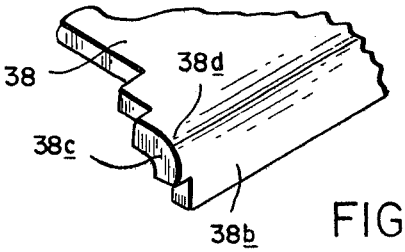
FIG. 8 is an enlarged perspective view of a rounded ear on the clamping member.

The clamp assembly is employed in the following manner: the clamping member 38 is pivotally adjusted to its open position as shown in FIG. 5. This permits relative movement of the arcuate pressure plate 34 relative to the bottom wall 30, it being understood that the extent of this relative movement is limited by the dimensions of the square holes 35 receiving the ears 34*e*. The bracelet section 20B is slidably inserted in the space 36 between the pressure plate 34 and the bottom wall 30. By moving the bracelet section 20B in relation to the clamp assembly 14, the latter is properly located to suit the wrist size of the wearer. Once this has been accomplished, the clamping member 38 is pivoted downwardly in a counterclockwise direction as viewed in the drawings. During the initial portion of this downward pivotal movement, a corner of the nose 38*b* comes into contact with the convex side 34*b* of the pressure plate, causing the pressure plate to be resiliently deflected to the maximum extent possible as shown in FIG. 6. When the bracelet section 20B is fairly thick, the pressure plate will be nearly flattened. As pivotal motion of the clamping member continues, the rounded external portions 38*d* of ears 38*c* will rotatably engage the circular edges of holes 40, thus producing a smooth motion as the clamping member arrives at the closed position shown in FIG. 7. At this point, the flat edge of nose 38*b* will be in contact with the convex side 34*b*, thus permitting the pressure plate to deflect back slightly and to resume its arcuate shape, but in a resiliently stressed condition with a larger radius of curvature. The bracelet section 20B is now positively gripped on the top surface by the resilient pressure plate along two lines located at opposite ends of its concave side 34*a*, and on its bottom surface by the bottom wall 30.

The coupling assembly 12 is then attached to the clamp assembly 14 by first engaging the hook 28 of base frame 16 over the upturned lip 34*c* of the pressure plate 34. The cover 26 is then pivoted downwardly to its closed position as shown in FIG. 2. Small stamped protrusions 26*a* on the cover side walls 26*b* snap into the rectangular holes 35 to hold the cover in the closed position.

The advantages made possible by the present invention will now be better appreciated by those skilled in the art. For example, as a result of transferring the resiliency feature from the clamping member 38 to the pressure plate 34, the clamping member now consists of a simple flat stamping with downturned noses 38*a*, 38*b* at its opposite ends. This simplifies the manufacture of this element while also reducing costs. This advantage is achieved without complicating the design of the pressure plate 34, which now consists of a simple spring-like element, also susceptible to straightforward relatively inexpensive manufacturing techniques.

The provision of an integral upturned lip 34*c* on the pressure plate eliminates the need for a separate cross pin. This further reduces costs, while improving on the appearance of the clasp by eliminating a set of holes in the side walls 32.

The smooth rotating action of the clamping member 38 as a result of the rounded ear segments 38*d* being journalled in the circular holes 40 is also an advantage which is obtained without any accompanying increase in the complexity or cost of the clasp.

We claim:

1. An adjustable clasp for interconnecting two sections of a bracelet, including in combination a coupling assembly secured to the end of one bracelet section, and a clamp assembly detachably fixable at selected locations along the length of the other bracelet section and being engageable with said coupling assembly, said clamp assembly comprising:

a bottom wall with opposed side walls extending substantially normal thereto;

a resilient pressure plate supported by said side walls, said pressure plate being arcuate in side elevation with a given radius of curvature in the unstressed or relaxed condition and with oppositely facing concave and convex sides, said concave side cooperating with said bottom wall to define a space therebetween; and a rigid clamping member supported by said side walls on the convex side of said pressure plate, said clamping member being adjustable between an open position permitting limited movement of said pressure plate relative to said bottom wall in order to accommodate slidable movement of the said other bracelet section through said space, and a closed position contacting said convex side and resiliently deflecting said pressure plate to increase its radius of curvature and to positively grip the said other bracelet section between the concave side of said pressure plate and said bottom wall.

2. The adjustable clasp of claim 1 wherein the radius of curvature of said arcuate pressure plate extends from an axis which is transverse to the direction of slidable movement of the one bracelet section through said space.

3. The adjustable clasp of claim 2 wherein said pressure plate is resiliently engaged with the said other bracelet section along two lines located at opposite ends of said concave side when said clamping member is in the closed position.

4. The adjustable clasp of claim 1 wherein said clamping member is rotatably adjusted between said open and closed positions about an axis extending in a direction transverse to the direction of slidable movement of said other bracelet section, said side walls having opposed circular apertures aligned with said axis, said clamping member having ears protruding laterally therefrom into said apertures, said ears having rounded surfaces engageable with the circular edges of said apertures during movement of said clamping member into and out of said closed position.

5. An adjustable clasp for interconnecting two sections of a bracelet, comprising:

(a) a clamp assembly detachably fixable at selected locations along the length of one bracelet section, said clamp assembly having (i) a bottom wall with opposed side walls extending substantially normal thereto;

(ii) a resilient pressure plate overlying said bottom wall and cooperating therewith to define a space therebetween, said pressure plate being arcuate in side elevation with a concave side facing towards said bottom wall and with a convex side facing away from said bottom wall, said pressure plate having laterally extending first ears received in aligned first openings in said side wall, said pressure plate being further provided with a lip extending upwardly from one end thereof; and (iii) a clamping member positioned adjacent to the convex side of said pressure plate, said clamping member having laterally extending second ears received in aligned second openings in said side walls, said clamping member being adjustable between an open position permitting limited movement of said pressure plate relative to said bottom wall in order to accommodate slidable movement of said one bracelet section through said space, and a closed position engaging said convex side to resiliently deflect said pressure plate towards said bottom wall to positively grip the one bracelet section therebetween; and (b) a coupling assembly secured to the other bracelet section, said coupling assembly being detachably engageable with the lip on said pressure plate.

6. An adjustable clasp for interconnecting two sections of a bracelet, includng in combination a coupling assembly secured to the end of one bracelet section, and a clamp assembly detachably fixable at selected locations along the length of the other bracelet section, said clamp assembly comprising:

a bottom wall with opposed side walls extending substantially normal thereto;

a resilient pressure plate supported by said side walls, said pressure plate cooperating with said bottom wall to define a space therebetween, said pressure plate having a lip extending away from said bottom wall, said coupling assembly being engageable with said lip; and a rigid clamping member also supported by said side walls, said clamping member being adjustable between an open position permitting limited movement of said pressure plate relative to said bottom wall in order to accommodate slidable movement of the said other bracelet section through said space, and a closed position resiliently deflecting said pressure plate to positively grip the said other bracelet section between said pressure plate and said bottom wall.

7. The adjustable clasp of claim 6 wherein said pressure plate is arcuate in side elevation, with a side thereof facing said bottom wall being concave, and with the opposite side thereof facing said clamping member being convex.

* * * * *